US008070004B2

(12) United States Patent
Williams et al.

(10) Patent No.: US 8,070,004 B2
(45) Date of Patent: Dec. 6, 2011

(54) CONTAINER FLOORING SYSTEM

(75) Inventors: John Michael Williams, Concord, CA (US); Michael S Hohndorf, Antioch, CA (US)

(73) Assignee: Institute of International Container Lessors, Washington, DC (US)

( * ) Notice: Subject to any disclaimer, the term of this patent is extended or adjusted under 35 U.S.C. 154(b) by 497 days.

(21) Appl. No.: 12/276,665

(22) Filed: Nov. 24, 2008

(65) Prior Publication Data

US 2010/0126376 A1 May 27, 2010

(51) Int. Cl.

| | |
|---|---|
| ***B65D 88/00*** | (2006.01) |
| ***B65D 25/24*** | (2006.01) |
| ***B65D 90/12*** | (2006.01) |
| ***B65D 6/14*** | (2006.01) |
| ***B61D 17/10*** | (2006.01) |

(52) U.S. Cl. ..... 220/1.5; 220/626; 220/628; 220/636; 217/5; 217/17; 217/36; 105/422

(58) Field of Classification Search ..... 220/1.5, 220/626, 628, 636; 217/5, 17, 36; 105/422
See application file for complete search history.

(56) References Cited

U.S. PATENT DOCUMENTS

| | | | |
|---|---|---|---|
| 4,848,617 | A | 7/1989 | Zygaj |
| 4,976,365 | A | 12/1990 | Seo |
| 5,794,960 | A | 8/1998 | Sill et al. |
| 2003/0146212 | A1 | 8/2003 | Mai et al. |
| 2008/0179319 | A1 | 7/2008 | Nielsen et al. |

FOREIGN PATENT DOCUMENTS

| | | |
|---|---|---|
| WO | WO 88/07477 | 6/1988 |
| WO | WO2010/059260 | 5/2010 |

OTHER PUBLICATIONS

International Search Report and Written Opinion for International Patent Application No. PCT/US2009/035415 dated Apr. 30, 2009.

*Primary Examiner* — Anthony Stashick
*Assistant Examiner* — Madison L Wright
(74) *Attorney, Agent, or Firm* — Stephen C. Glazier; K&L Gates LLP

(57) ABSTRACT

In various embodiments, shipping container systems are described included an extended tunnel flooring system with a steel floor piece running lengthwise down the center of the extended tunnel floor, and an Omega flooring system including alternating lengthwise strips of 6 wood floor pieces and 5 floor steel pieces on a structure of support beams reinforced with steel gusset plate.

19 Claims, 14 Drawing Sheets

CONTAINER FLOORING SYSTEM

BACKGROUND

The flooring system may be an important and expensive component of a shipping container. The flooring used in a shipping container may be made of wood, such as hardwood, including tropical and Asian hardwoods. The hardwood may be formed into plywood flooring. The flooring may be supported by a steel sub-floor. A shipping container floor may need to handle the rigorous demands of cargo transport, and may need to be durable, resilient, and cost effective to maintain, repair and clean.

As the demand for certain types of wood, for example, Asian hardwoods, for use as shipping container flooring increases, the quality and quantity of the wood available may decline. This may make it harder to procure enough wood of good enough quality to be used as shipping container floors, which may reduce the number of shipping containers that can be produced, or reduce the quality of the flooring of the containers that are produced.

A shipping container's flooring, under normal operating conditions, should last the entire useful life of the container. If a container's flooring fails prematurely, the flooring or possibly the entire container may need to be replaced. The additional wood that is required in replacement of the failed floor may exert greater demands on available supplies of hardwood. The flooring may also be required to meet standards, for example, standards set by the International Organization for Standardization, standards governing TIR and TCT certification, or standards found in agreements such as the International Convention for Safe Containers.

The object of the embodiments of the present inventions provide flooring for shipping containers requiring less wood than flooring currently in use, resulting in lower maintenance and repair costs for the flooring while still allowing the flooring to be strong enough to meet the various standards and requirements for shipping container floorings, including supporting certain maximum load weight without failing.

BRIEF DESCRIPTION OF THE FIGURES

The utility of the embodiments will be readily appreciated and understood from consideration of the following description of the embodiments when viewed in connection with the accompanying drawings. FIGS. 1-5 show prior art. FIGS. 6-14 show embodiments of the present invention.

FIG. 1 depicts a top down view of a section of an exemplary standard flooring;

FIG. 3 depicts a photograph of an exemplary standard flooring in a shipping container;

FIG. 4 depicts a top down view of a section of an exemplary standard flooring with a gooseneck tunnel;

FIG. 6 depicts a top down view of a section of an exemplary extended tunnel flooring;

FIG. 8 depicts a cutaway top angled view of a section of an exemplary extended tunnel flooring;

FIG. 9 depicts side and front views of an exemplary front bottom rail and door sill with exemplary steel gussets;

FIG. 10 depicts a photograph of an exemplary extended tunnel flooring in a shipping container;

FIG. 11 depicts a top down view of a section of an exemplary Omega flooring;

FIG. 13 depicts a cutaway top angled view of a section of an exemplary Omega flooring;

FIG. 14 depicts a photograph of an exemplary Omega flooring in a shipping container.

DESCRIPTION

For the purposes of this description most shipping containers have long rectangular floors with a length of about 20' to 40' or longer and a width of about 8'.

Various embodiments of the invention provide a shipping container flooring system. In one embodiment, a first wood floor piece is placed lengthwise against a first inner side rail, a second wood floor piece is placed lengthwise against a second inner side rail oriented parallel to the first inner side rail, such that the second inner side rail is not in between the first wood floor piece and the second wood floor piece, and a steel floor piece is placed in the space in between the first wood floor piece and the second wood floor piece. See FIG. 6.

In another embodiment, a first wood floor piece is placed lengthwise against a first side of a container and a second wood floor price is placed lengthwise against a second side of the container opposite the first side of the container. A first steel floor piece is placed lengthwise next to the first wood floor piece and a second steel floor piece is placed lengthwise next to the first wood floor piece. A third wood floor piece is placed lengthwise next to the first steel floor piece, a fourth wood floor piece is placed lengthwise next to the second steel floor piece, and a third steel floor piece is placed in between the third wood floor piece and the fourth wood floor piece. See FIG. 10.

Prior Art

Figure 1:
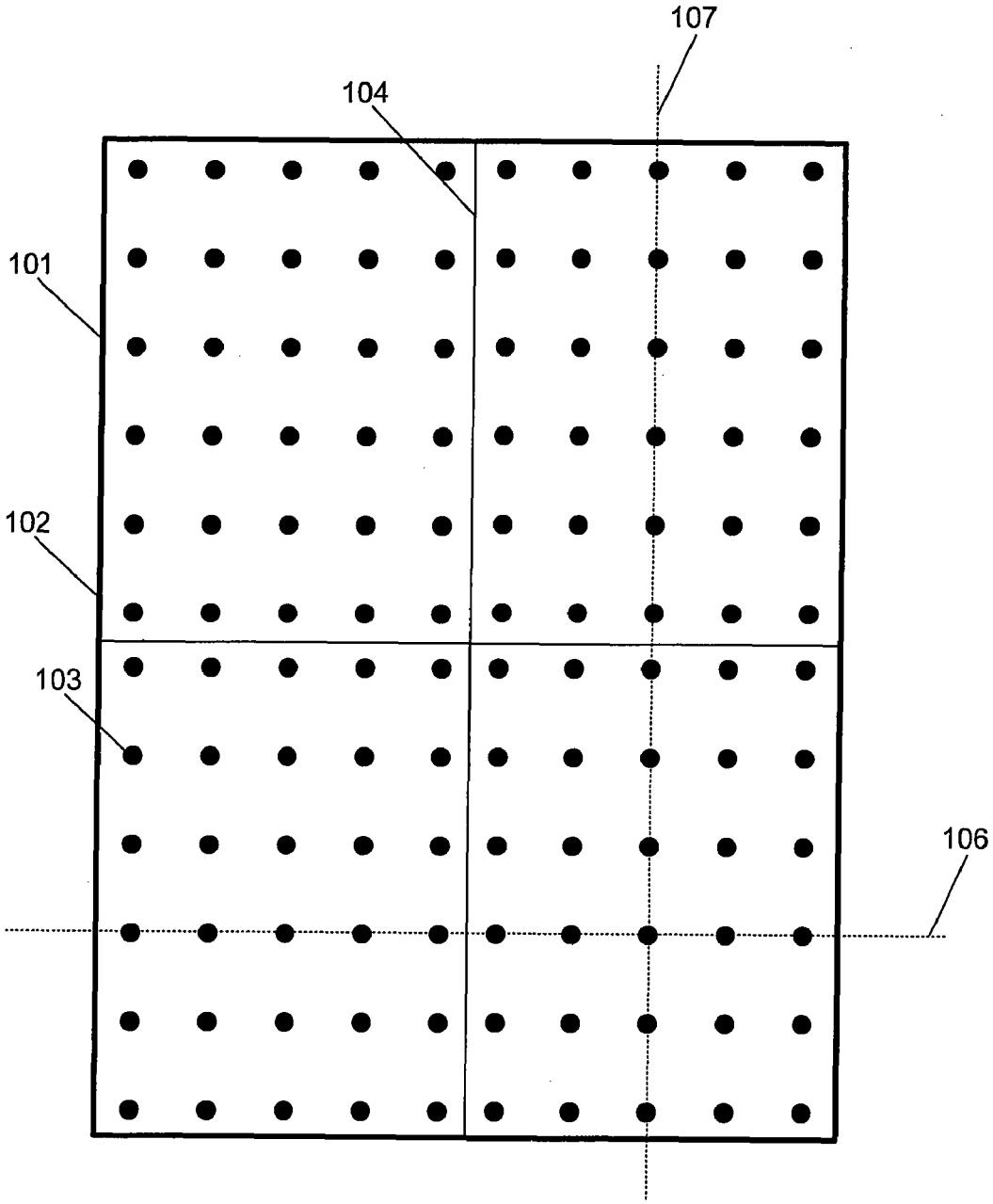
Figure 1 PRIOR ART

FIG. 1 depicts a top down view of a section of an exemplary standard flooring. The standard floor 101 may be a type of floor already known and in use as the floor of shipping container, on which cargo placed in the shipping container may rest. The entire standard floor 101 of the standard flooring may be made from wood. This may result in a large amount of hardwood being required for the manufacture of the standard floor 101. The standard flooring may include a standard floor 101 made of wood floor pieces 102. The wood floor piece 102 may be constructed of any suitable wood using any suitable technique. For example, the wood floor pieces 102 may be 19-ply hardwood plywood. Maintenance and repair of the standard floor 101 may be expensive because, for example, if the standard floor 101 is made of four wood floor pieces 102, damage to one of the wood floor pieces 102 necessarily requires repair or replacement of one quarter of the floor.

The wood floor pieces 102 of the standard floor 101 may be held to the body of the shipping container through the use of any suitable fastener or joining mechanism, such as, for example, a self-tapping screw 103. Gaps or seams between the wood floor pieces 102 of the standard floor 101 may be sealed using any suitable sealant 104, such as, for example, chloroprene or butyl sealant.

Figure 2A:
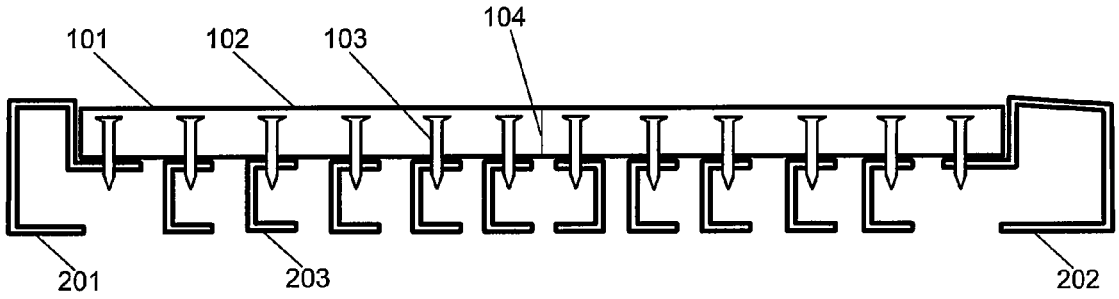
Figure 2a PRIOR ART
FIGS. 2*a*-2*b* depict side and front views of a section of an exemplary standard flooring.
Figure 2B:
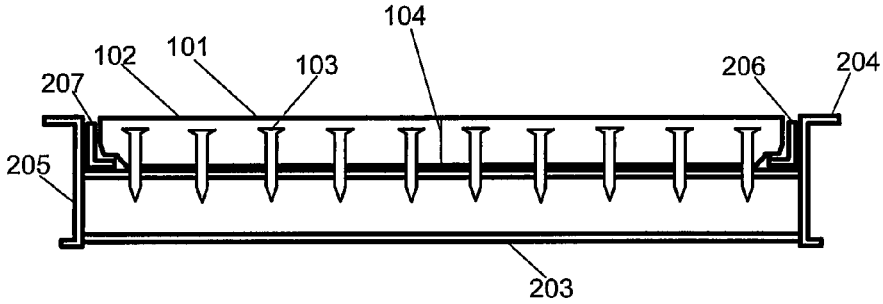
Figure 2b PRIOR ART

FIGS. 2*a*-2*b* depict side and front views of a section of an exemplary standard flooring. FIG. 2*a* may be a cross-section of FIG. 1, taken along cross-section line 107. In FIG. 2*a*, the standard floor 101, including wood floor pieces 102, may be secured to a support beam 203 with the self-tapping screws 103. The self-tapping screws 103 may be, for example, zinc-plated self-tapping screws, and may be countersunk into the wood floor pieces 102. The standard floor 101 may lay in the space in between the front bottom rail 201 and the door sill 202. The door sill 202 may be positioned at the back of the shipping container, just below the doors of the shipping container. The front bottom rail 201 may be positioned at the front of the shipping container.

The front bottom rail 201, the door sill 202, and the support beams 203 may be made from any suitable material, such as, for example, anti-corrosive steel such as Corten A steel, SPA-H steel, and B480 steel. The support beams 203 may be C-Beams, positioned to face towards the door sill 202, except for the support beam 203 positioned close to a point halfway down the length of the shipping container, which may be reversed to face the support beam 203 on the other side of the halfway point. The front bottom rail 201 and the door sill 202 may be shaped such that they provide support to the standard floor 101 while serving their functions at the front and back of the shipping container.

FIG. 2*b* may be a cross-section of FIG. 1, taken along cross-section line 106. In FIG. 2*b*, the standard floor 101, including wood floor pieces 102, may lay in the space between a first inner side rail 206 and a second inner side rail 207, on top of the support beams 203. The support beams 203, the front bottom rail 201 and the door sill 202 may span the width of the shipping container in which the standard floor 101 is installed. The width of the shipping container may be the distance between a first outer side rail 204 and a second outer side rail 205.

The first outer side rail 204 and the second outer side rail 205 may be made from any suitable material, including the same material as the support beams 203. The first outer side rail 204 and the second outer side rail 205 may be C-beams where the top of the C is longer than the bottom of the C, and may run the length of the shipping container, and may be positioned such that the C faces outward from the shipping container. The support beams 203 may run in between the backside of the first outer side rail 204 and the second outer side rail 205, and may be secured to the first outer side rail 204 and the second outer side rail 205 using any suitable joining technique, such as, for example, $CO_2$ welding.

The first outer side rail 204, the second outer side rail 205, the front bottom rail 201, and the door sill 202 may form a rectangular frame that may serve as the base of the shipping container. Any flooring for the shipping container may fit within the rectangular frame.

The first inner side rail 206 and the second inner side rail 207 may be positioned next to the first outer side rail 204 and the second outer side rail 205, respectively, on top of the support beams 203, and may run the length of the floor 101. The first inner side rail 206 and the second inner side rail 207 may be made from any suitable material, including the same material as the support beams 203, and may be inward facing L-beams attached to the first outer side rail 204, the second outer side rail 205, and the support beams 203 by any suitable joining technique, such as, for example, stitch welding. The outside edges of the wood floor pieces 102 may be grooved so as to rest on top of the first inner side rail 206 and the second inner side rail 207. Any gaps or seams between the edge of the wood floor pieces 102 and the first inner side rail 206 and the second inner side rail 207 may be sealed using any suitable sealant 104, such as, for example, chloroprene or butyl sealant.

Figure 3:
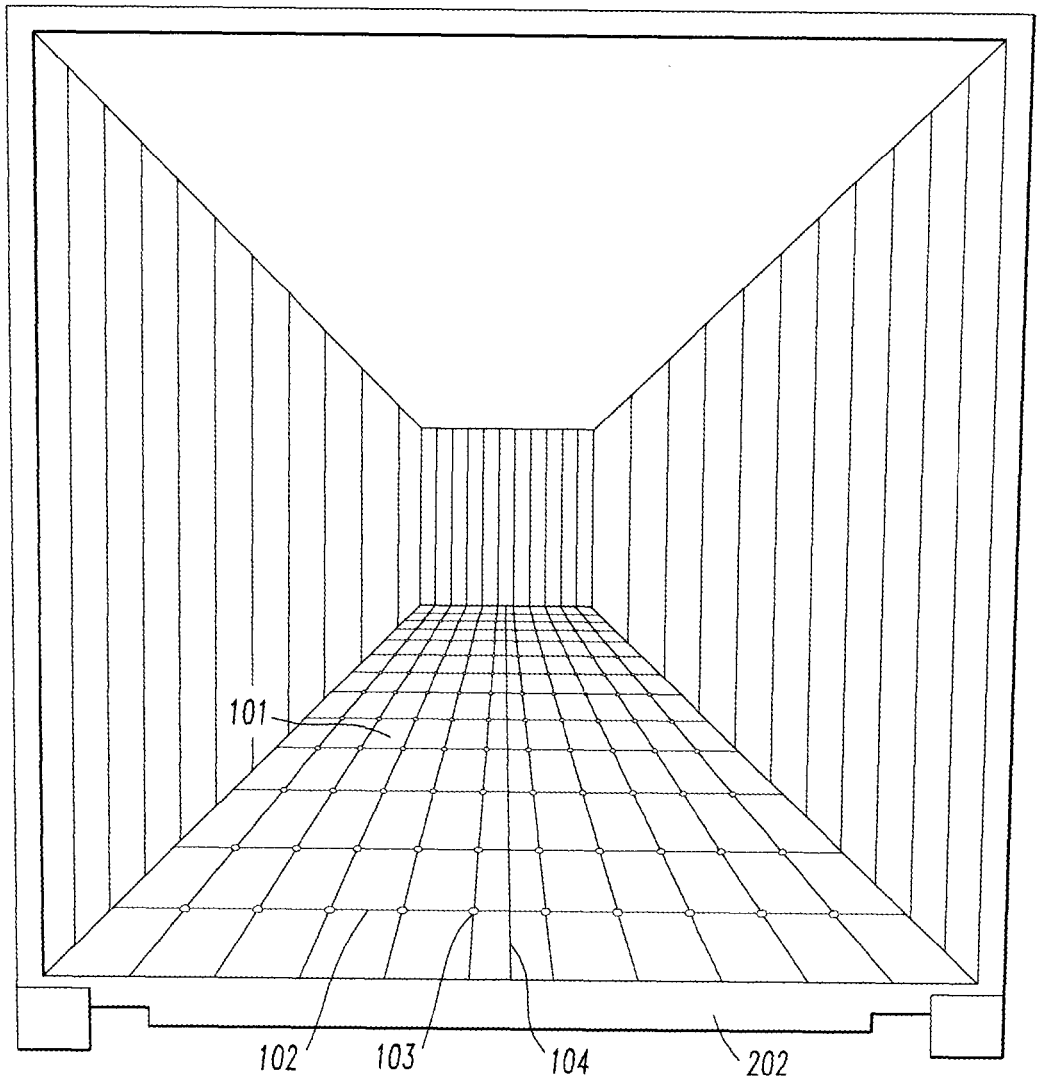
Figure 3 PRIOR ART

FIG. 3 depicts a photograph of an exemplary standard container flooring in a shipping container. The standard floor 101 may be used in the assembly of a shipping container. The four exemplary wood floor pieces 102 depicted in FIG. 3 may serve as the floor of the shipping container.

Figure 4:
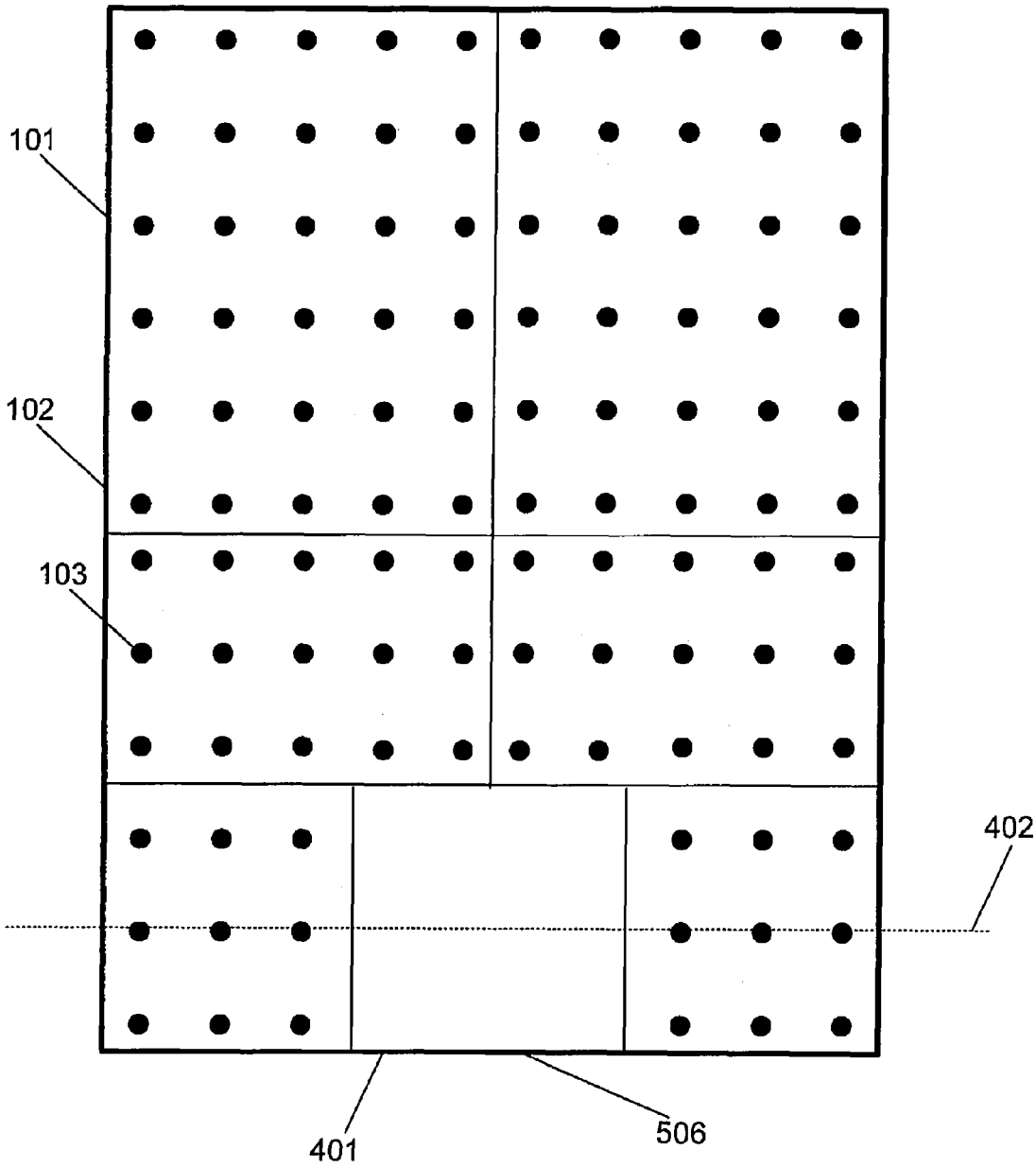
Figure 4 PRIOR ART

FIG. 4 depicts a top down view of a section of an exemplary standard flooring with a gooseneck tunnel. The standard floor 101 may be modified to add a gooseneck tunnel 506. The wood floor pieces 102 nearest the front bottom rail 201 may be reduced in size so that a gooseneck steel floor piece 401 may be added to the standard floor 101. The gooseneck steel floor piece 401 may be made from any suitable material, including the same material as the support beams 203, and may be centered relative to the front bottom rail 201. Gaps or seams between the wood floor pieces 102 and the gooseneck steel floor piece 401 of the standard floor 101 may be sealed using any suitable sealant 104, such as, for example, chloroprene or butyl sealant.

Figure 5A:
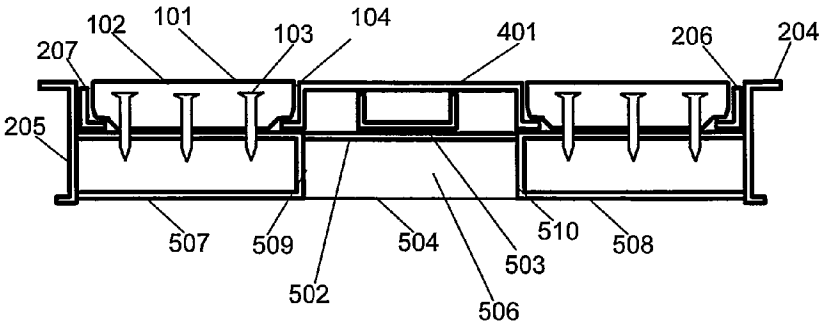
Figure 5a PRIOR ART
FIGS. 5*a*-5*b* depict a front view and a bottom angled view of a section of an exemplary standard flooring with a gooseneck tunnel.
Figure 5B:
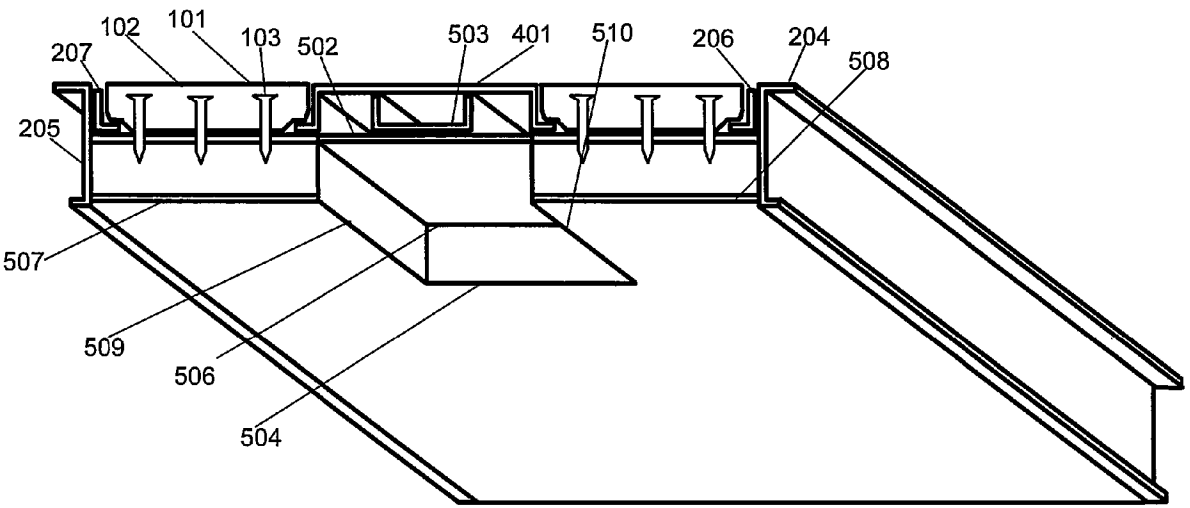
Figure 5b PRIOR ART

FIGS. 5*a*-5*b* depict a front view and a bottom angled view of a section of an exemplary standard flooring with a gooseneck tunnel. FIG. 5*a* may be a cross-section of FIG. 4, taken along cross-section line 402. In FIG. 5*a*, the gooseneck steel floor piece 401 may lay in between two wood floor pieces 102, allowing the surface of the floor 101 to remain level. Below the gooseneck steel floor piece 401, the support beams 203 may be reduced in size, similar to support beams 507 and 508. The space in between the reduced size support beams 507 and 508 may be left empty, forming a gooseneck tunnel 506.

The gooseneck tunnel 506 may be bounded by a steel top plate 502, first steel side wall 509, second steel side wall 510, and steel rear wall 504, which, along with the gooseneck steel floor piece 401, may all be held in place using any suitable joining technique, such as, for example, $CO_2$ welding. The gooseneck steel floor piece 401 may be supported by steel floor support 503, which may be made from any suitable material, including the same material as the support beams 203, and may be a support rail in the form of a C-beam. The steel floor support 503 C-beam may be positioned under the gooseneck steel floor piece 401, opening upwards. Gaps or seams between the steel floor support 503 and the gooseneck steel floor piece 401 may be filled with a steel filler. More than one steel floor support 503 may be used to reinforce the gooseneck steel floor piece 401.

FIG. 5*b* may be a bottom angled view of FIG. 4. In FIG. 5*b*, the gooseneck tunnel 506 extends underneath the standard floor 101 for the length of the gooseneck steel floor piece 401. The gooseneck tunnel 506 may allow the shipping container to be transported in a position close to horizontal when acting as the trailer in a tractor-trailer, as a hitch of the trailer may be lined up with the gooseneck tunnel 506.

Extended Tunnel Flooring

Figure 6:
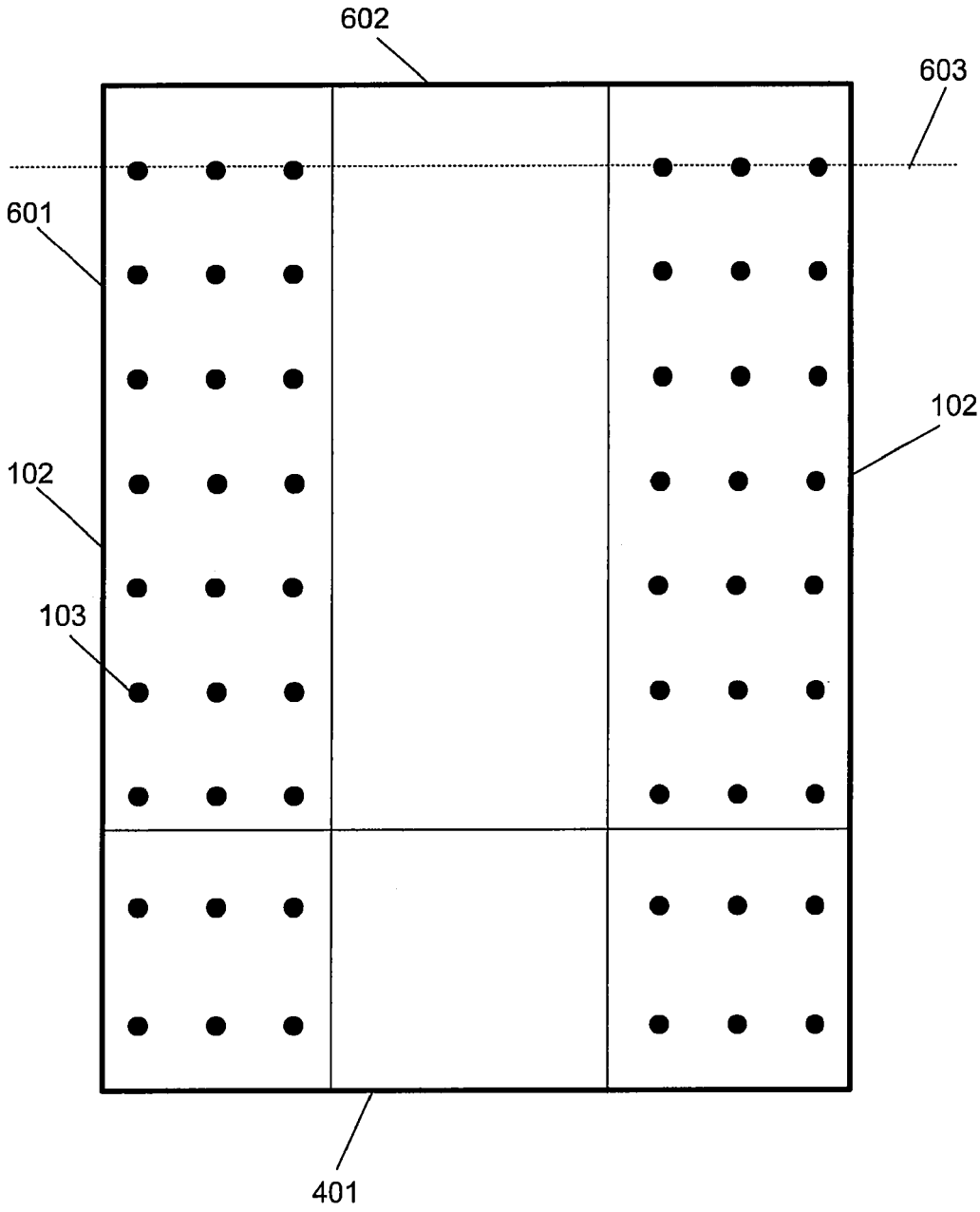

FIG. 6 depicts a top down view of a section of an exemplary extended tunnel flooring. In a first exemplary embodiment, the standard floor 101 with the gooseneck tunnel 506 may be modified to extend part of the gooseneck tunnel 506 structure the length of the standard floor 101. This may result in an extended tunnel floor 601. A similar structure of rails used for the rectangular frame for the standard floor 101 may be used for the extended tunnel floor 601. The extended tunnel floor 601 may include wood floor pieces 102 on both sides of the extended floor 601. The center of the extended tunnel floor 601 may include gooseneck steel floor piece 401 and extended steel floor piece 602. The gooseneck steel floor piece 401 and the extended steel floor piece 602 may run the length of the extended floor 601. Gaps or seams between the wood floor pieces 102 and the gooseneck steel floor piece 401 and the extended steel floor piece 602 may be sealed using any suitable sealant 104, such as, for example, chloroprene or butyl sealant.

In an alternative embodiment, if the shipping container is constructed without the gooseneck tunnel 506, the extended steel floor piece 602 may run the length of the extended floor 601. In another alternative embodiment, the extended steel floor piece 602 may include multiple steel floor pieces.

Figure 7A:
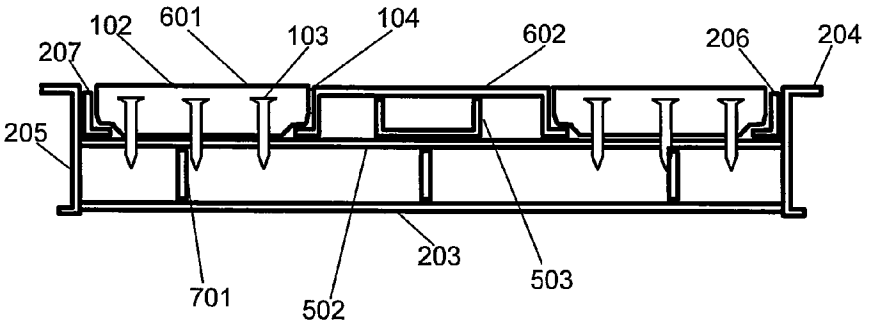
FIGS. 7*a*-7*b* depict a front view and a top angled view of a section of an exemplary extended tunnel flooring.

FIGS. 7*a*-7*d* depict a front view and a top angled view of a section of an exemplary extended tunnel flooring. FIG. 7*a* may be cross-section of FIG. 6 taken along cross-section line 603. In FIG. 6*a*, the extended floor 601 may lay in the same position as the standard floor 101 as shown in FIG. 5*a*. However, the cross-section of FIG. 7*a* shows the extended steel floor piece 602 instead of the gooseneck steel floor piece 401. Below the extended floor piece 602, the support beams 203 may not be reduced in size as they are under the gooseneck steel floor piece 401. Instead, the support beams 203 may run the width of the extended floor 601, between the first outer side rail 204 and the second outer side rail 205. The extended steel floor piece 602 and the steel support 503 may lay on the support beams 203, and may be attached to the support beams through any suitable joining technique, such as, for example, for example, $CO_2$ welding.

The support beams 203 for the extended floor 601 may be reinforced with steel gussets 701. The steel gussets 701 may be thin plates of steel that fit within the C of the C-beam of the support beams 203. For example, three steel gussets 701 may be used to reinforce each of the support beams 203. The steel gussets 701 may be attached to the support beams 203 using any suitable joining technique, such as, for example, $CO_2$ welding. The steel gussets 701 may fill in an entire slice of the C of the C-beams of the support beams 203, but may not protrude beyond the C of the C-beams. If the legs of the C-beam are of different lengths, the steel gussets 701 may be trapezoids shaped to fit the C.

Figure 7B:
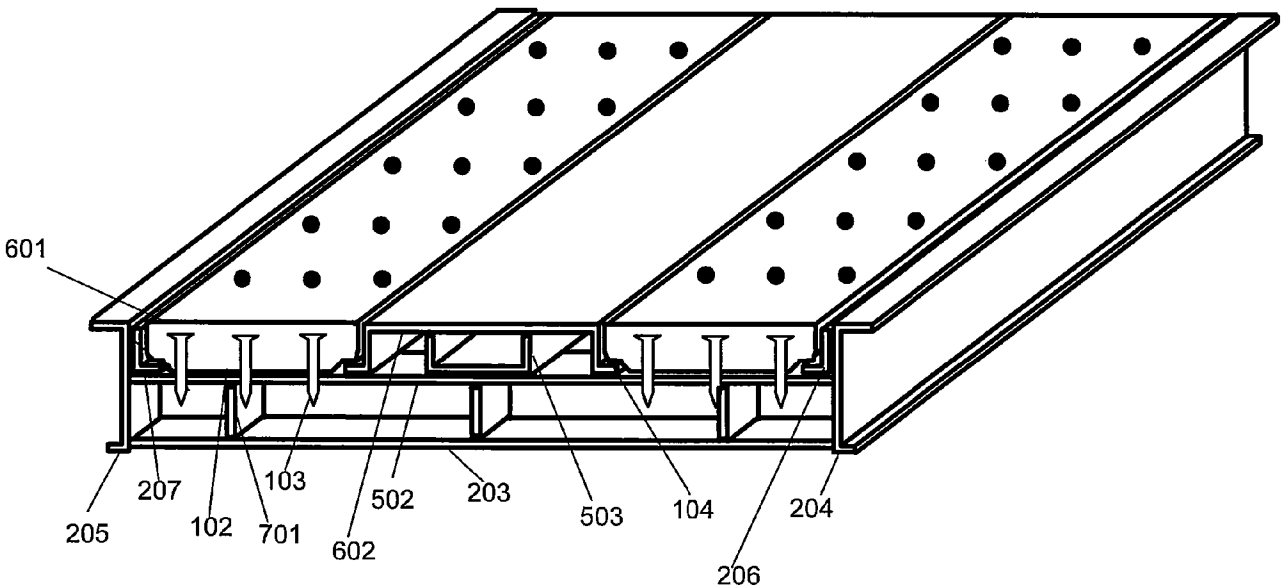

FIG. 7*b* may be a top angled view of FIG. 7. The section of FIG. 7 depicted in FIG. 7*b* does not include the gooseneck steel floor piece 401. In FIG. 7*b*, the steel floor support 503 runs the length of the extended tunnel floor 601 under the extended steel floor piece 602. The top of the support beam 203 is visible in FIG. 7*b* under the extended steel floor piece 602. However, the space in between the top of the support beam 203, the bottom and side of the extended steel floor piece 602, and the steel floor support 503 may be filled with steel filler. More than one steel floor support 503 may be used to reinforce the extended steel floor piece 602.

Figure 8:
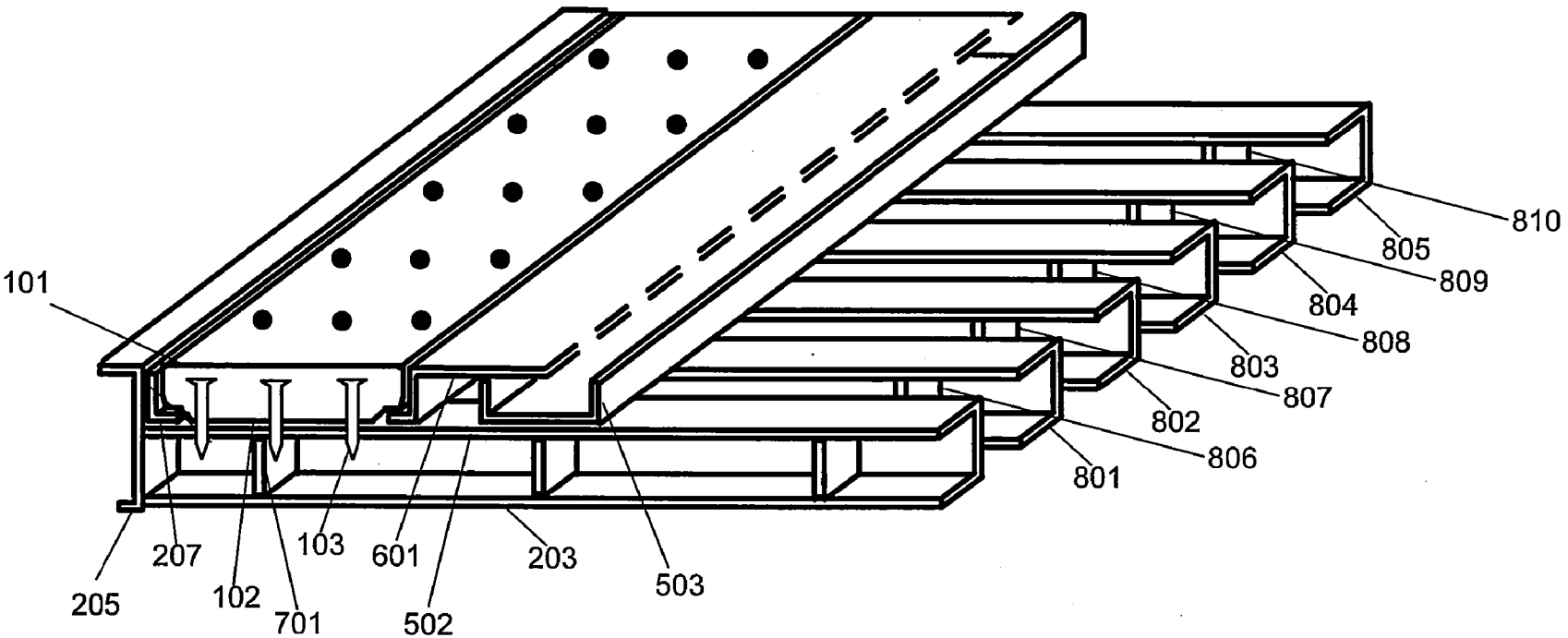

FIG. 8 depicts a cutaway top angled view of a section of an exemplary extended tunnel flooring. The wood floor piece 102, the first outer side rail 204, the first inner side rail 206 and half of the extended steel floor piece 602, have been removed from the depiction of the extended tunnel floor 601 in FIG. 8, to allow a view of the structure underneath the extended tunnel floor 601.

The support beams 801, 802, 803, 804 and 805 may be spaced out evenly underneath the extended tunnel floor 601, with C-beams facing in the same direction, towards the door sill 202. As with the standard flooring 101, one of the support beams 203 near the halfway point of the length of the extended tunnel floor 601 may face the opposite direction. This section of the extended tunnel floor 601 is not depicted in FIG. 8.

The self-tapping screws 103 used to attach the wood floor pieces 102 to the support beams 203 may be lined up with the support beams 801, 802, 803, 804 and 805. This may allow the wood floor pieces 103 to be securely attached to the rest of the shipping container.

The steel gussets 806, 807, 808, 809 and 810 are visible in FIG. 8, attached to the support beams 801, 802, 803, 804 and 805, respectively. The steel gussets 701 may be distributed among the support beams 203 in any suitable manner, for example, not every support beam 203 may have the steel gussets 701.

As stated above, the steel floor support 503 may run the length of the extended tunnel floor 601 underneath the extended steel floor piece 602. The steel floor support 503 may lie on top of, and be attached by any suitable joining technique to one or more of, the support beams 801, 802, 803, 804 and 805.

The extended tunnel floor 601 may be supported by more of the support beams 203 than the standard floor 101. For example, in a 40' shipping container the standard floor 101 may be supported by 28 of the support beams 203, while the extended tunnel floor 601 may be supported by 30 of the support beams 203.

Figure 9:
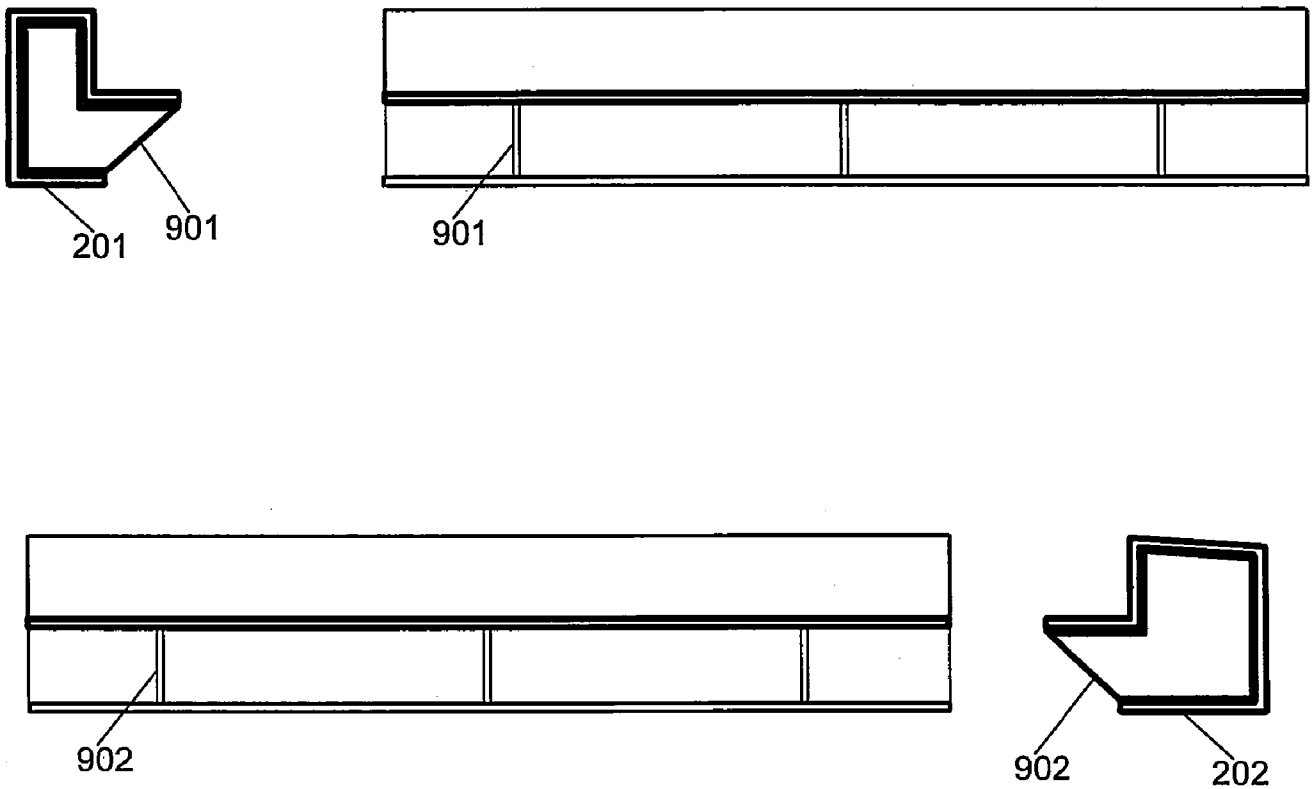

The front bottom rail 201 and door sill 202 may also be reinforced with the steel gussets 1202. FIG. 9 depicts side and front views of an exemplary front bottom rail and door sill with exemplary steel gussets. The front bottom rail 201 used with the extended tunnel floor 601 may be reinforced by steel gussets 901. The steel gussets 901 may be thin steel plates shaped to fit internally into the front bottom rail 201. In an exemplary embodiment, three of the steel gussets 901 may be used to reinforce the front bottom rail 201. The door sill 202 used with the extended tunnel floor 601 may also be reinforced by steel gussets 902. The steel gussets 902 may be thin steel plates shaped to fit internally into the door sill 202. In an exemplary embodiment, three of the steel gussets 901 may be used to reinforce the front bottom rail 201.

Figure 10:
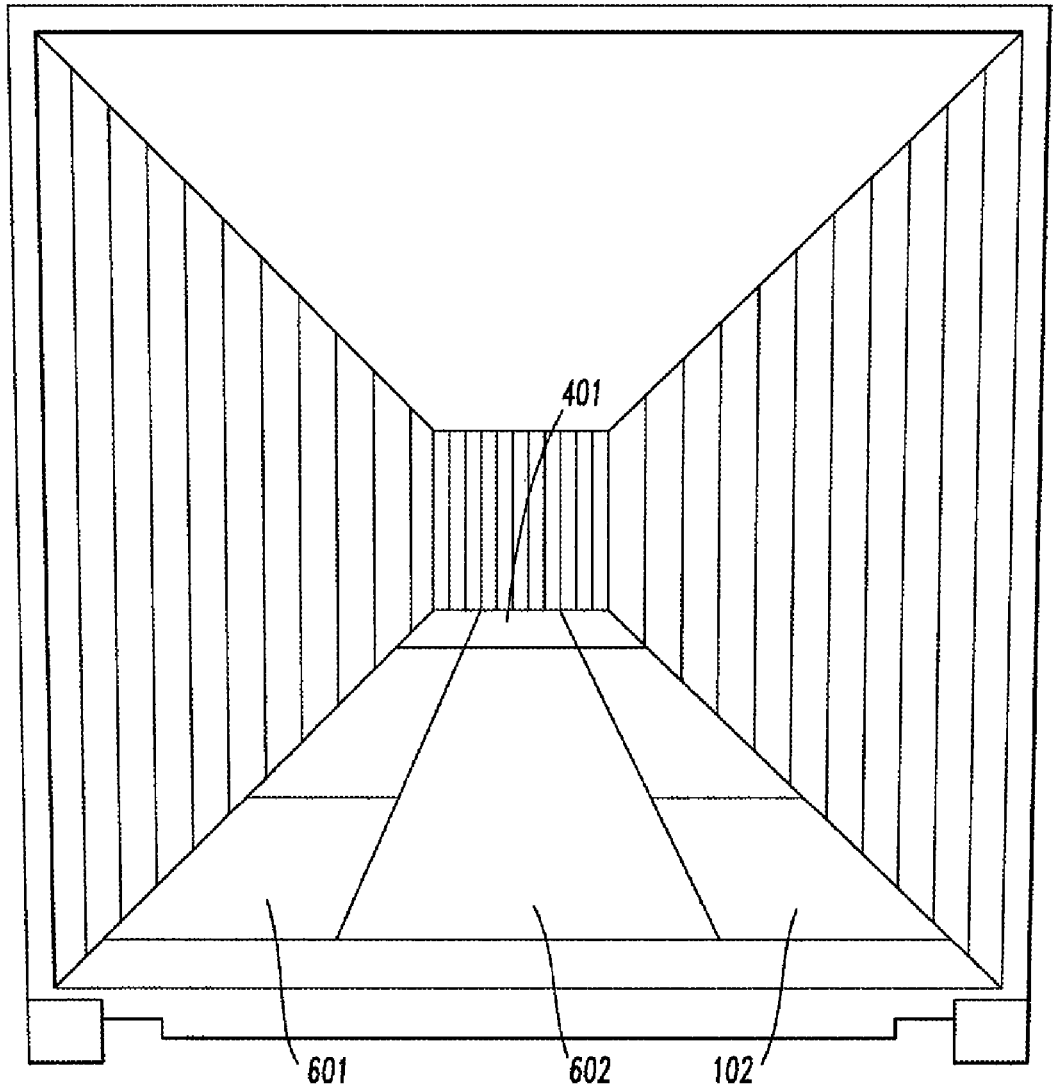

FIG. 10 depicts a photograph of an exemplary extended tunnel flooring in a shipping container. The extended tunnel floor 601 may be used in the assembly of a shipping container. The six exemplary wood floor pieces 102 depicted in FIG. 10 may serve as part of the floor of the shipping container. The gooseneck steel floor piece 401 and the extended steel floor piece 602 may serve as the rest of the floor of the shipping container.

As depicted in FIG. 10, the extended tunnel floor 601 may require the use of less wood than the standard floor 101. Where the entirety of the standard floor 101 may be wood, a portion of the extended tunnel floor 601 may be steel. This may also result in the extended tunnel floor 601 being easier and cheaper to construct, repair and maintain than the standard floor 101, as the quantity and quality of wood used for the standard floor 101 decreases.

In one exemplary embodiment, the extended tunnel floor 601 may be used as the floor for an exemplary 20' long shipping container. The external dimensions of the exemplary shipping container may be a length of 19'10½", a width of 8', and a height of 8'6". The internal dimensions of the exemplary shipping container maybe a length of 19'4 13/64", a width of 7'8 33/64", and a height of 7'10 3/32". The extended tunnel floor 601 in the exemplary shipping container may support a maximum payload of 61,930 pounds.

The shipping container may be held together in part by welding and sealants. Exterior welding may be continuous welding using $CO_2$ gas. Interior welding may be done using a minimum bead length of 15 mm. Welding may only be used on gaps not in excess of 3 mm between pieces of the shipping container. Chloroprene sealant may be used around the periphery of the extended tunnel floor 601 and inside unwelded seams. Butyl sealant may be used to caulk invisible seams.

The exemplary shipping container may include a rectangular frame to which the extended tunnel floor 601 may be attached. The rectangular frame may be constructed of an exemplary first outer side rail 204, an exemplary second outer side rail 205, an exemplary door sill 202 and exemplary front bottom rail 201. Each of the exemplary outer side rails 204 and 205 may be built of 48×158×30×4.5 mm thick cold-formed channel section steel made in one piece. The first exemplary inner side rail 206 and the second exemplary inner side rail 207 may be 3 mm thick pressed angel section steel, and may be attached to the outer side rails 204 and 205 by staggered stitch welding. The front bottom rail 201 may be made of 4 mm thick pressed open section steel reinforced by three internal 4 mm thick steel gussets 701. A 200×75 mm section may be cut out at each end of the front bottom rail 201 and reinforced with a 200×75 mm piece of channel steel. The door sill 202 may be made of 4.5 mm thick pressed open section steel reinforced by four internal 4 mm thick steel gussets 701. The upper face of the door sill 202 may have a 10 mm slop for better drainage. A 200×75 mm section may be cut out at each end of the door sill 202 and reinforced with a 200×75 mm piece of channel steel.

The support beams 203 of the exemplary shipping container may be made of pressed channel section steel with dimensions of 45×122×45×4 mm, and 75×122×45×4.0 mm with three pieces of 4 mm thick gussets for the floor butt joints. 18 of the support beams 203 may be welded to the outer side rails 204 and 205. The front bottom rail 202 may be welded to the outer side rails 204 and 205 at one end, to serve as the front end of the shipping container, and the door sill 202 may be welded to the other end, to serve as the back end of the shipping container, where a door will be located.

The extended tunnel floor 601 in the exemplary shipping container may be made of 6 wood floor pieces 102 of 28 mm thick 19-ply hardwood plywood, one extended steel floor piece 602, and self-tapping screws 103. The wood floor pieces 102 may be, for example, made from Apiton or Keruing or Hybrid hardwood plys glued together with phenol-formaldehyde resin and treated with a preservative such as Meganium 2000. The extended steel floor piece 602 may be 4.5 mm thick and reinforced by three steel floor supports 503, which may be 4 mm thick pressed C-section steel. The self-tapping screws 103 may have an 8 mm diameter shank, 16 mm diameter head, and a length of 45 mm.

The 6 wood floor pieces 102 may be laid longitudinally on the support beams 203 on each side of the extended steel floor piece 602, which may be centered on the width of the shipping container and welded to the support beams 203. The 6 wood floor pieces 102 may be secured to the support beams 203 through the use of three self-tapping screws 103 for each support beam 203 under an individual wood floor piece 102, countersunk 2 mm in to the wood floor piece 102. All of the butt joint areas and peripheries of the wood floor pieces 102 may be caulked with sealant.

Omega Flooring

Figure 11:
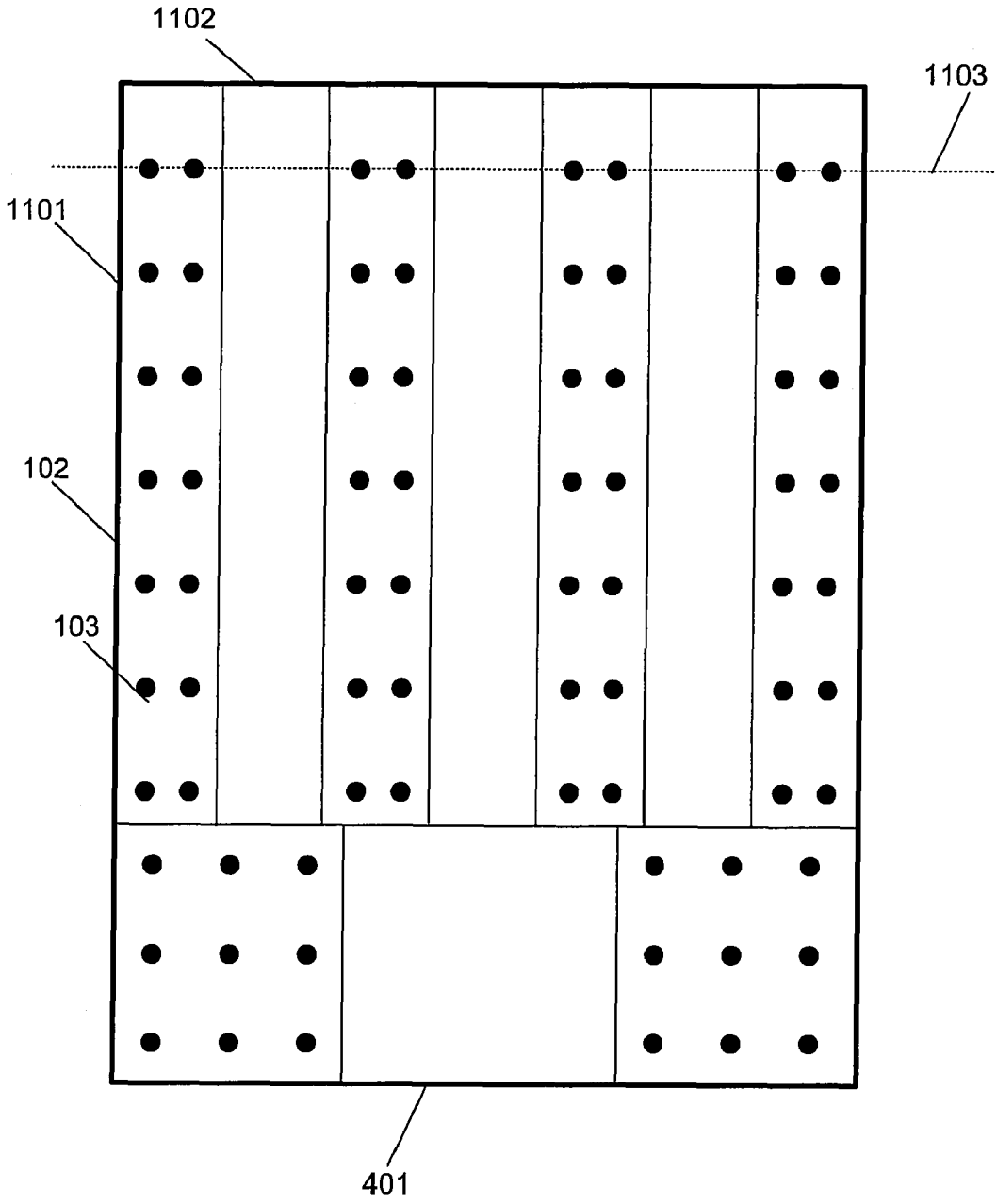

FIG. 11 depicts a top down view of a section of an exemplary Omega flooring. In a second exemplary embodiment, the standard floor 101 may be modified to use alternating wood floor pieces 102 and steel floor pieces 1102. This may result in an Omega floor 1101. A similar structure of rails used for the rectangular frame for the standard floor 101 may be used for the Omega floor 1101. The Omega floor 1101 may include the wood floor pieces 102 on both sides of the Omega floor 1101, against the first inner side rail 206 and the second inner side rail 207. In between the wood floor pieces 102 on both sides of the Omega floor 1101, the steel floor pieces 1102 may alternate with the wood floor pieces 102. The steel floor pieces 1102 and wood floor pieces 102 may be sized so that the alternation results in one steel floor piece 1102 being at the center of the Omega floor 1101.

The Omega floor 1101 may include a gooseneck tunnel 506, including the gooseneck steel floor piece 401. If the Omega floor 1101 includes a gooseneck tunnel 506, the gooseneck steel floor piece 401 and the wood floor pieces 102 to the sides of the gooseneck steel floor piece 401 may take up the width of the Omega floor 1101. The alternating steel floor pieces 1102 and wood floor pieces 102 may run from the back end of the gooseneck steel floor piece 401 and the wood floor pieces 102 to the sides of the gooseneck steel floor piece 401 to the door sill 202. In an alternative embodiment, the steel floor pieces 1102 may include multiple steel floor pieces.

Gaps or seams between the wood floor pieces 102 and the gooseneck steel floor piece 401 and the steel floor pieces 1102 may be sealed using any suitable sealant 104, such as, for example, chloroprene or butyl sealant.

Figure 12A:
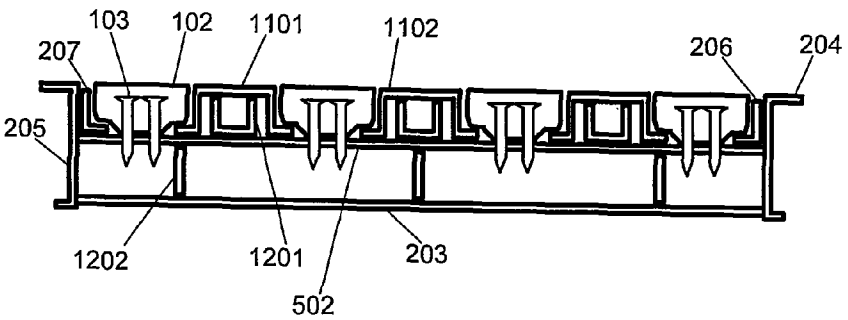
FIGS. 12*a*-12*b* depict a front view and a top angled view of a section of an exemplary Omega flooring.

FIGS. 12*a*-12*d* depict a front view and a top angled view of a section of an exemplary Omega flooring. FIG. 12*a* may be cross-section of FIG. 11 taken along cross-section line 1103. In FIG. 11*a*, the Omega floor 1101 may lay in the same position as the standard floor 101 as shown in FIG. 5*a*. The wood floor pieces 102 may alternate with the steel floor pieces 1102, with the wood floor pieces 102 being next to the first inner side rail 206 and the second inner side rail 207, and one of the steel floor pieces 1102 being centered on the width of the Omega floor 1101. The steel floor pieces 1102 may be supported by steel floor supports 1201, which may be made from any suitable material, including the same material as the support beams 203, and may be support rails in the form of C-beams. The steel floor supports 1201 C-beams may be positioned under the steel floor pieces 1102, opening upwards.

Below the Omega floor 1101, the support beams 203 may run the width of the Omega floor 1101, between the first outer side rail 204 and the second outer side rail 205. The wood floor pieces 102 and the steel floor pieces 1102 may lay on the support beams 203, and may be attached to the support beams through any suitable joining technique, such as, for example, for example, $CO_2$ welding. The support beams 203 for the Omega floor 1101 may be reinforced with steel gussets 1202. The steel gussets 1202 may be thin plates of steel that fit within the C of the C-beam of the support beams 203. For example, three steel gussets 1202 may be used to reinforce each of the support beams 203, and may be spaced out in such a way that the steel gussets 1202 are underneath the steel floor pieces 1102. The steel gussets 1202 may be attached to the support beams 203 using any suitable joining technique, such as, for example, $CO_2$ welding.

The front bottom rail 201 and door sill 202 may also be reinforced with the steel gussets 1202. As discussed above, FIG. 9 depicts side and front views of an exemplary front bottom rail and door sill with exemplary steel gussets. The front bottom rail 201 used with the Omega floor 1101 may be reinforced by steel gussets 901. The steel gussets 901 may be thin steel plates shaped to fit internally into the front bottom rail 201. In an exemplary embodiment, three of the steel gussets 901 may be used to reinforce the front bottom rail 201. The door sill 202 used with the Omega floor 1101 may also be reinforced by steel gussets 902. The steel gussets 902 may be thin steel plates shaped to fit internally into the door sill 202. In an exemplary embodiment, three of the steel gussets 901 may be used to reinforce the front bottom rail 201.

Figure 12B:
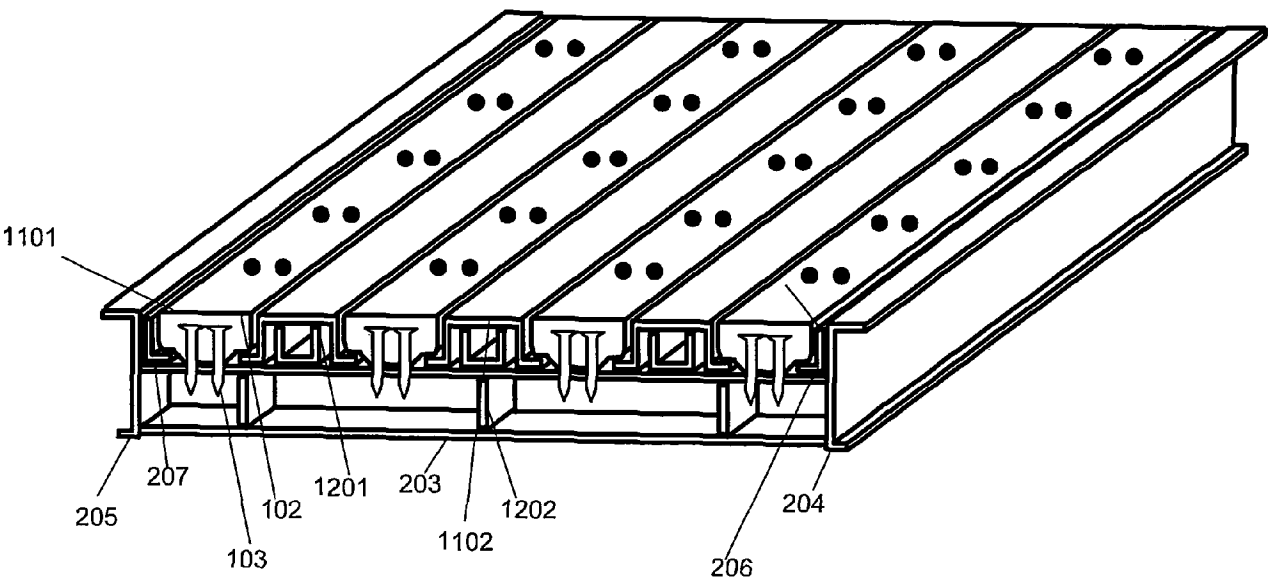

FIG. 12*b* may be a top angled view of FIG. 11. The section of FIG. 11 depicted in FIG. 7*b* does not include the gooseneck steel floor piece 401. In FIG. 7*b*, the steel floor supports 1201 run the length of the steel floor pieces 1102, under the steel floor pieces 1102. The top of the support beam 203 is visible in FIG. 7*b* under the steel floor pieces 1102. However, the space in between the top of the support beam 203, the bottom and side of the steel floor pieces 1102, and the steel floor supports 1201 may be filled with steel filler. The steel gussets 1202 may fill in an entire slice of the C of the C-beams of the support beams 203, but may not protrude beyond the C of the C-beams. If the legs of the C-beam are of different lengths, the steel gussets 1202 may be trapezoids shaped to fit the C.

Figure 13:
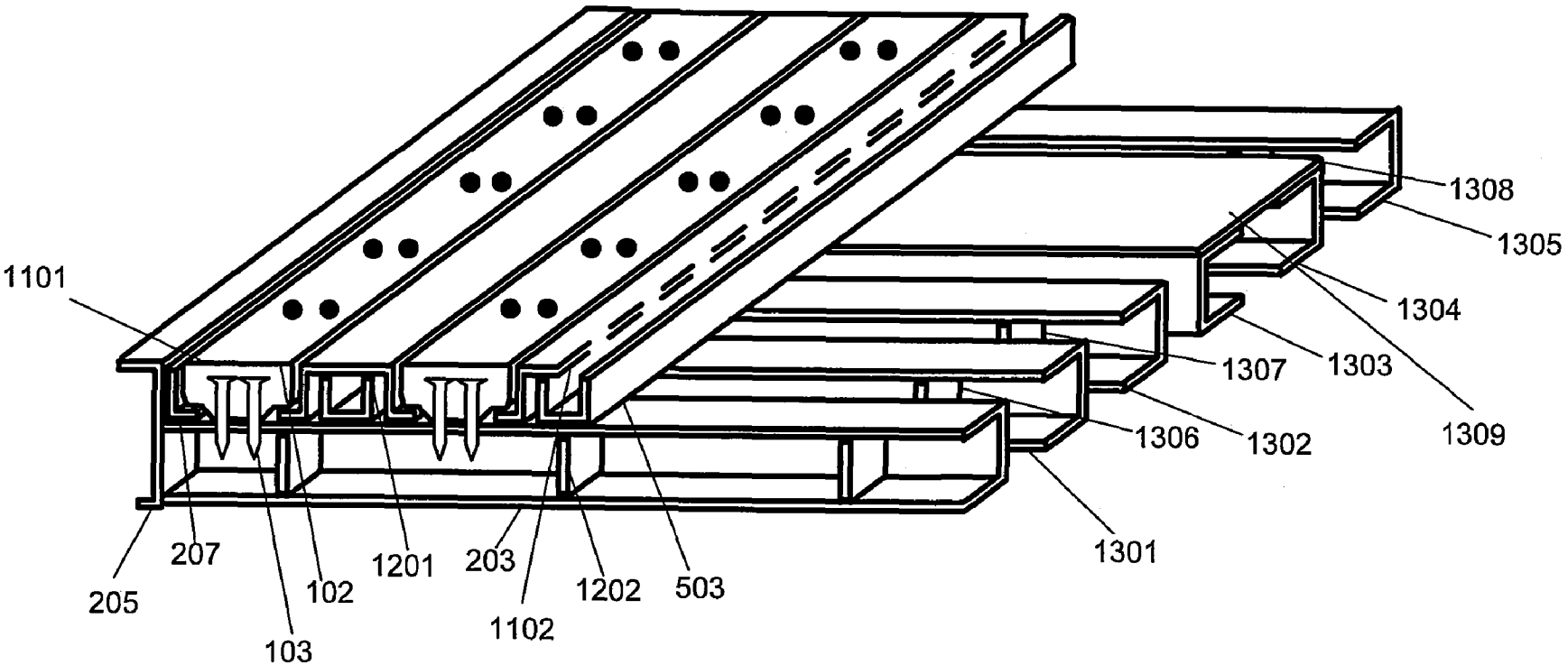

FIG. 13 depicts a cutaway top angled view of a section of an exemplary Omega flooring. Two of the wood floor pieces 102, one of the steel floor pieces 1102, the first outer side rail 204, the first inner side rail 206 and half of the center steel floor piece 1102, have been removed from the depiction of the Omega floor 1101 in FIG. 13, to allow a view of the structure underneath the Omega floor 1101.

The support beams 1301, 1302, 1303, 1304 and 1305 may be spaced out evenly underneath the Omega floor 1101. The C-beams for support beams 1301, 1302, 1304, and 1305 may face in the same direction, towards the door sill 202. The support beam 1303 may face in the opposite direction, away from the door sill 202, in order to provide further support to the Omega floor 1101. Where two adjacent support beams 203 face in opposite directions, such as the support beams 1303 and 1304, a steel top plate 1309 may be attached, for example by welding, to the tops of the two adjacent support beams 203 to join and reinforce the adjacent support beams 203. Additional support beams 203 under the Omega floor 1101 may face away from the door sill 202, and be joined to an adjacent support beam 203 via a steel top plate 1309, based on the design of the shipping container. For example, in a 40' long shipping container with the Omega Floor 1101, three of the support beams 203 at regular intervals may face away from the door sill 202.

The steel gussets 1306, 1307, and 1308 are visible in FIG. 13, attached to the support beams 1301, 1302, and 1305, respectively. The steel gussets 1202 may be distributed among the support beams 203 in any suitable manner, for example, not every support beam 203 may have the steel gussets 1202.

The self-tapping screws 103 used to attach the wood floor pieces 102 to the support beams 203 may be lined up with the support beams 1301, 1302, 1303, 1304 and 1305. This may allow the wood floor pieces 103 to be securely attached to the rest of the shipping container.

As stated above, the steel floor supports 1201 may run the length of the steel floor pieces 1102 underneath the steel floor pieces 1102. The steel floor supports 1201 may lie on top of, and be attached by any suitable jointing technique to one or more of, the support beams 1301, 1302, 1303, 1304 and 1305.

Figure 14:
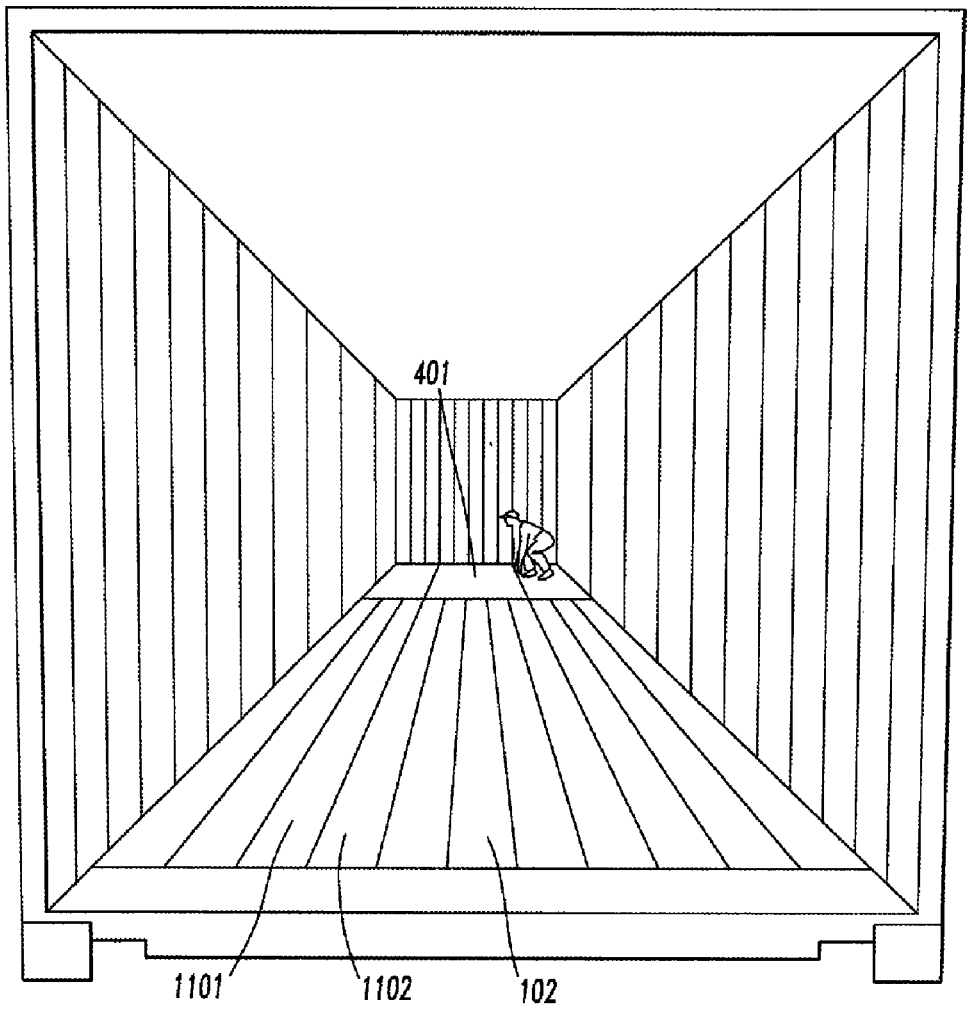

FIG. 14 depicts a photograph of an exemplary Omega flooring in a shipping container. The Omega floor 1101 may be used in the assembly of a shipping container. The eight exemplary wood floor pieces 102 depicted in FIG. 10 may serve as part of the floor of the shipping container. The gooseneck steel floor piece 401 and the five steel floor pieces 1102 may serve as the rest of the floor of the shipping container. Two of the wood floor pieces 102 and the gooseneck steel floor piece 401 may be aligned near the front bottom rail 201, while the six remaining wood floor pieces 102 may alternate with the five steel floor pieces 1102 across the width of the Omega floor 1101, from the back of the gooseneck steel floor piece 401 to the door sill 202.

As depicted in FIG. 11, the Omega floor 1101 may require the use of less wood than the standard floor 101. Where the entirety of the standard floor 101 may be wood, a portion of the Omega floor 1101 may be steel. This may also result in the Omega floor 1101 being easier and cheaper to construct, repair and maintain than the standard floor 101, as the quantity and quality of wood used for the standard floor 101 decreases. When one of the wood pieces 102 of the Omega floor 1101 is damaged, only that wood piece 102 may need to be replaced. This may save on material costs, as no individual wood piece 102 makes up a large section of the Omega floor 1101. The steel floor pieces 1102 of the Omega floor 1101 may also be more resistant to damage than the wood pieces 102.

The steel gussets 1202 may be critical to the construction of the Omega floor 1101. The steel gussets 1202 may reinforce the support beams 203 so that the support beams 203 do not collapse under load due to twisting failure, scissors failure, or any other structural failures of the support beam 203. Without the steel gussets 1203, the Omega floor 1101 may collapse under loads no heavier than the maximum load the Omega floor 1101 may be required to support to allow the Omega floor 1101 to be used in shipping containers.

In a test, an Omega floor 1101 of 40' that was built without the steel gussets 1202 structurally failed under a load no heavier than the maximum load the Omega floor 1101 may be required to support. After the steel gussets 1202 were added to the Omega floor 1101, the Omega floor 1101 passed the test. Three of the steel gussets 1202, 3 mm thick, were used per support beam 203 in the successful test of the Omega floor 1101. The steel gussets 1202 may therefore be critical to the success of the Omega floor 1101.

In one exemplary embodiment, the Omega floor 1101 may be used as the floor for an exemplary 20' long shipping container. The external dimensions of the exemplary shipping container may be a length of 19'10½", a width of 8', and a height of 8'6". The internal dimensions of the exemplary shipping container maybe a length of 19'4$^{13}/_{64}$", a width of 7'8$^{33}/_{64}$", and a height of 7'10$^{3}/_{32}$". The Omega floor 1101 in the exemplary shipping container may support a maximum payload of 61,930 pounds.

The shipping container may be held together in part by welding and sealants. Exterior welding may be continuous welding using $CO_2$ gas. Interior welding may be done using a minimum bead length of 15 mm. Welding may only be used on gaps not in excess of 3 mm between pieces of the shipping container. Chloroprene sealant may be used around the periphery of the extended tunnel floor 601 and inside unwelded seams. Butyl sealant may be used to caulk invisible seams.

The exemplary shipping container may include a rectangular frame to which the extended tunnel floor 601 may be attached. The rectangular frame may be constructed of an exemplary first outer side rail 204 and an exemplary second outer side rail 205, and an exemplary door sill 202 and exemplary front bottom rail 201. Each of the exemplary outer side rails 204 and 205 may be built of 48×158×30×4.5 mm thick cold-formed channel section steel made in one piece, and may have 4 mm thick steel reinforcement plates welded to the bottom corner fittings. The first exemplary inner side rail 206 and the second exemplary inner side rail 207 may be 3 mm thick pressed angel section steel, and may be attached to the outer side rails 204 and 205 by staggered stitch welding. The front bottom rail 201 may be made of 4 mm thick pressed open section steel reinforced by three internal 4 mm thick steel gussets 1202. A 200×75 mm section may be cut out at each end of the front bottom rail 201 and reinforced with a 200×75 mm piece of channel steel. The door sill 202 may be made of 4.5 mm thick pressed open section steel reinforced by four internal 4 mm thick steel gussets 1202. The upper face of the door sill 202 may have a 10 mm slop for better drainage. A 200×75 mm section may be cut out at each end of the door sill 202 and reinforced with a 200×75 mm piece of channel steel.

The support beams 203 of the exemplary shipping container may be made of pressed channel section steel with dimensions of 45×122×45×4 mm, and 75×122×45×4.0 mm with three pieces of 4 mm thick gussets for the floor butt joints. 16 of the support beams 203 may be welded to the outer side rails 204 and 205. The front bottom rail 202 may be welded to the outer side rails 204 and 205 at one end, to serve as the front end of the shipping container, and the door sill 202 may be welded to the other end, to serve as the back end of the shipping container, where a door will be located.

The Omega floor 1101 in the exemplary shipping container may be made of 18 wood floor pieces 102 of 28 mm thick 19-ply hardwood plywood, five steel floor pieces 1102, and self-tapping screws 103. The wood floor pieces 102 may be, for example, made from Apiton or Keruing or Hybrid hardwood plys glued together with phenol-formaldehyde resin and treated with a preservative such as Meganium 2000. The steel floor pieces 1102 may be 4 mm thick and reinforced by one steel floor support 503, which may be 4 mm thick pressed C-section steel. The self-tapping screws 103 may have an 8 mm diameter shank, 16 mm diameter head, and a length of 45 mm.

The 18 wood floor pieces 102 may be laid longitudally on the support beams 203 in six strips of three wood floor pieces. Two of the strips of the wood floor pieces 102 may be laid next to the first inner side rail 206 and the second inner side rail 207, and in between the two of the strips, the five steel floor pieces 1102 may alternate with the remaining 4 strips of wood floor pieces 102, so that each steel floor piece 1102 lies in between two wood floor pieces 102. The steel floor pieces 1102 may be welded to the support beams 203. The 18 wood floor pieces 102 may be secured to the support beams 203 through the use of one or two self-tapping screws 103 for each support beam 203 under an individual wood floor piece 102, countersunk 2 mm in to the wood floor piece 102, and all of the butt joint areas and peripheries of the wood floor pieces 102 may be caulked with sealant.

Every component above referred as steel may, in other embodiments, be made of any other suitable material, including metals, composites, and plastics.

It is to be understood that the figures and descriptions of the present invention have been simplified to illustrate elements that are relevant for a clear understanding of the present invention, while eliminating, for purposes of clarity, other elements. Those of ordinary skill in the art will recognize, however, that these and other elements may be desirable. However, because such elements are well known in the art, and because they do not facilitate a better understanding of the present invention, a discussion of such elements is not provided herein. It should be appreciated that the figures are presented for illustrative purposes and not as construction drawings. Omitted details and modifications or alternative embodiments are within the purview of persons of ordinary skill in the art.

It can be appreciated that, in certain aspects of the present invention, a single component may be replaced by multiple components, and multiple components may be replaced by a single component, to provide an element or structure or to perform a given function or functions. Except where such substitution would not be operative to practice certain embodiments of the present invention, such substitution is considered within the scope of the present invention.

The examples presented herein are intended to illustrate potential and specific implementations of the present invention. It can be appreciated that the examples are intended primarily for purposes of illustration of the invention for those skilled in the art. The diagrams depicted herein are provided by way of example. There may be variations to these diagrams or the operations described herein without departing from the spirit of the invention. For instance, in certain cases, method steps or operations may be performed or executed in differing order, or operations may be added, deleted or modified.

Furthermore, whereas particular embodiments of the invention have been described herein for the purpose of illustrating the invention and not for the purpose of limiting the same, it will be appreciated by those of ordinary skill in the art that numerous variations of the details, materials and arrangement of elements, steps, structures, and/or parts may be made within the principle and scope of the invention without departing from the invention as described in the following claims.

What is claimed is:

1. A shipping container flooring system comprising:

a first wood floor piece disposed lengthwise against a first side of a container;

a second wood floor piece disposed lengthwise against a second side of the container opposite the first side of the container; and an extended steel floor piece disposed in a space in between the first wood floor piece and the second wood floor piece, wherein the extended steel floor piece comprises an extension of a gooseneck tunnel and extends a full length of a container floor.

2. A shipping container flooring system comprising:

a first wood floor piece disposed lengthwise against a first inner side rail;

a second wood floor piece disposed lengthwise against a second inner side rail oriented parallel to the first inner side rail, such that the second inner side rail is not in between the first wood floor piece and the second wood floor piece; and an extended steel floor piece disposed in a space in between the first wood floor piece and the second wood floor piece, wherein the extended steel floor piece extends a full length of a container floor.

3. The shipping container flooring system of claim 2, wherein the extended steel floor piece is disposed such that there is a gap no greater than 3 mm between the extended steel floor piece and the first wood floor piece and the extended steel floor piece and the second wood floor piece.

4. The shipping container flooring system of claim 3, wherein the gap between the extended steel floor piece and the first wood floor piece and the gap between the extended steel floor piece and the second wood floor piece are filled with a sealant.

5. The shipping container flooring system of claim 4, further comprising a steel floor support disposed under the extended steel floor piece to support the extended steel floor piece.

6. A shipping container flooring system comprising:

a first outer side rail comprising a C-beam;

a second outer side rail comprising a C-beam parallel to the first outer side rail, wherein the C-beam of the second outer side rail faces away from the first outer side rail, and the C-beam of the first outer side rail faces away from the second outer side rail;

a support beam comprising a C-beam disposed perpendicular to the first side rail and the second rail, where the C-beam of the support beam faces to a back of the first side rail and the second side rail;

a first inner side rail comprising an L-beam, disposed next to and parallel to the first outer side rail, such that the L-beam faces the second outer side rail;

a second inner side rail comprising an L-beam, disposed next to and parallel to the second outer side rail, such that the L-beam faces the first outer side rail;

a first wood floor piece disposed lengthwise next to the first inner side rail, such that a bottom of the first wood floor piece lays on a top of the support beam;

a second wood floor piece disposed lengthwise next to the second inner side rail, such that a bottom of the second wood floor piece lays on the top of the support beam; and an extended steel floor piece disposed in between the first wood floor piece and the second wood floor piece, wherein the extended steel floor piece extends an entire length of a container floor, such that a bottom of the extended steel floor piece lays on the top of the support beam.

7. The shipping container flooring system of claim 6, wherein the first wood floor piece and the second wood floor piece are secured to the support beam by at least one self-tapping screw.

8. The shipping container flooring system of claim 6, wherein the extended steel floor piece is secured to the support beam by welding.

9. The shipping container flooring system of claim 6, further comprising a steel floor support disposed under the extended steel floor piece to support the extended steel floor piece.

10. The shipping container flooring system of claim 6, wherein the extended steel floor piece comprises a sheet of steel where a first side of the sheet of steel is bent down at a 90 degree angle forming a first leg, and a second side of the sheet of steel opposite the first side is bent down at a 90 degree angle forming a second leg of a same length as the first leg, and wherein the first leg is bent up at a 90 degree angle away from the sheet of steel forming a first protrusion, and the second leg is bent up at a 90 degree angle away from the sheet of steel forming a second protrusion.

11. The shipping container flooring system of claim 10, wherein a steel floor support comprises a C-beam placed upside down under the sheet of steel in between the first leg and the second leg.

12. A shipping container flooring system comprising:

a first wood floor piece disposed lengthwise against a first side of a container;

a second wood floor piece disposed lengthwise against a second side of the container opposite the first side of the container;

a first steel floor piece disposed lengthwise next to the first wood floor piece;

a second steel floor piece disposed lengthwise next to the second wood floor piece;

a third wood floor piece disposed lengthwise next to the first steel floor piece;

a fourth wood floor piece disposed lengthwise next to the second steel floor piece;

a third steel floor piece disposed in between the third wood floor piece and the fourth wood floor piece;

a support beam comprising a C-beam, disposed underneath the first, second, third, and fourth wood floor piece and the first, second and third steel floor pieces such that the first, second, third, and fourth wood floor piece and the first, second and third steel floor pieces lay on a top of the support beam; and wherein the support beam further comprises a steel gusset plate disposed in a hollow inner section of the C-beam, such that the gusset plate is next to a top, bottom and back of the hollow inner section of the C-beam.

13. The shipping container flooring system of claim 12, wherein an open-end of the C-beam of the support beam faces the open-end of the C-beam of a second support beam.

14. The shipping container flooring system of claim 12, wherein a top plate comprising a steel sheet is disposed on top of and attached to a support beam and the second support beam, joining the support beam to the second support beam.

15. The shipping container flooring system of claim 12, wherein the steel gusset plate is 3 mm thick.

16. The shipping container flooring system of claim 12, wherein three steel gusset plates are disposed within a support beam.

17. A shipping container flooring system comprising:

a first outer side rail comprising a C-beam;

a second outer side rail comprising a C-beam parallel to the first outer side rail, wherein the C-beam of the second outer side rail faces away from the first outer side rail, and the C-beam of the first outer side rail faces away from the second outer side rail;

a support beam comprising a C-beam disposed perpendicular to the first side rail and the second rail, where the C-beam of the support beam faces to a back of first side rail and the second side rail;

a first inner side rail comprising an L-beam, disposed next to and parallel to the first outer side rail, such that the L-beam faces the second outer side rail;

a second inner side rail comprising an L-beam, disposed next to and parallel to the second outer side rail, such that the L-beam faces the first outer side rail;

a floor comprising alternating wood floor pieces and steel floor pieces, disposed in between the first inner side rail and the second inner side rail, such that a steel floor piece is disposed halfway in between the first side rail and the second side rail; and wherein the support beam further comprises a steel gusset plate disposed in a hollow inner section of the C-beam, such that the gusset plate is next to a top, bottom and back of the hollow inner section of the C-beam.

18. The shipping container flooring system of claim 17, further comprising:

a support beam comprising a C-beam, disposed underneath the floor, such that the floor lies on top of the support beam.

19. A shipping container flooring system comprising;

a first wood floor piece disposed lengthwise against a first side of a container;

a second wood floor piece disposed lengthwise against a second side of the container opposite the first side of the container;

alternating wood floor pieces and steel floor pieces, disposed in between the first wood floor piece and the second wood floor piece, such that a steel floor piece is disposed halfway in between a first side rail and a second side rail;

a support beam comprising a C-beam disposed perpendicular to the first side and the second side of the container, where the C-beam of the support beam faces to a back of the container; and wherein the support beam further comprises a steel gusset plate disposed in a hollow inner section of the C-beam, such that the gusset plate is next to a top, bottom and back of the hollow inner section of the C-beam.

* * * * *